US007496305B2

(12) United States Patent
Watanabe

(10) Patent No.: US 7,496,305 B2
(45) Date of Patent: Feb. 24, 2009

(54) METHOD AND APPARATUS FOR IMAGE FORMING CAPABLE OF EFFECTIVELY CORRECTING OUTPUT FROM TONER DENSITY SENSOR

(75) Inventor: Naoto Watanabe, Atsugi (JP)

(73) Assignee: Ricoh Co., Ltd., Tokyo (JP)

( * ) Notice: Subject to any disclaimer, the term of this patent is extended or adjusted under 35 U.S.C. 154(b) by 97 days.

(21) Appl. No.: 11/582,990

(22) Filed: Oct. 19, 2006

(65) Prior Publication Data

US 2007/0086797 A1 Apr. 19, 2007

(30) Foreign Application Priority Data

Oct. 19, 2005 (JP) ..... 2005-304475

(51) Int. Cl.
*G03G 15/06* (2006.01)

(52) U.S. Cl. ..... 399/61; 399/27; 399/30; 399/58

(58) Field of Classification Search ..... 399/27, 399/30, 28, 58, 61; 347/262
See application file for complete search history.

(56) References Cited

U.S. PATENT DOCUMENTS

| | | | | |
|---|---|---|---|---|
| 5,298,960 | A * | 3/1994 | Fukuchi et al. | 399/29 |
| 5,353,103 | A * | 10/1994 | Okamoto et al. | 399/63 |
| 5,574,543 | A * | 11/1996 | Sakai et al. | 399/59 |
| 5,581,326 | A * | 12/1996 | Ogata et al. | 399/30 |
| 6,160,569 | A * | 12/2000 | Fujimori et al. | 347/262 |
| 6,332,063 | B1 * | 12/2001 | Ozawa et al. | 399/27 |
| 2006/0002724 | A1 | 1/2006 | Fujimori et al. | |
| 2007/0086797 | A1 | 4/2007 | Watanabe | |

FOREIGN PATENT DOCUMENTS

| | | | |
|---|---|---|---|
| JP | 04124685 A | * | 4/1992 |
| JP | 2002-207357 | | 7/2002 |
| JP | 2005172868 A | * | 6/2005 |

OTHER PUBLICATIONS

U.S. Appl. No. 11/932,198, filed Oct. 31, 2007, Takeuchi, et al.

* cited by examiner

*Primary Examiner*—David M Gray
*Assistant Examiner*—G. M. Hyder
(74) *Attorney, Agent, or Firm*—Oblon, Spivak, McClelland, Maier & Neustadt, P.C.

(57) ABSTRACT

An image forming apparatus using a two-component developer includes a sensor mechanism, an image forming mechanism, a toner supply controller, a memory, an estimation mechanism, and a correction mechanism. The sensor mechanism detects a toner density of the developer. The image forming mechanism produces a toner image at one of at least two selectable process linear speeds. The toner supply controller controls a toner amount based on a result by the sensor mechanism. The memory stores data of an external input voltage for adjusting a variation in an output voltage of the sensor mechanism. The estimation mechanism estimates a difference between output voltages of the sensor mechanism before and after a speed selection of the at least two linear speeds is changed. The correction mechanism corrects the output voltage of the sensor mechanism when a speed selection of the at least two selectable process linear speeds is changed.

11 Claims, 6 Drawing Sheets

METHOD AND APPARATUS FOR IMAGE FORMING CAPABLE OF EFFECTIVELY CORRECTING OUTPUT FROM TONER DENSITY SENSOR

CROSS-REFERENCE TO RELATED APPLICATION

This patent specification is based on Japanese patent application, No. 2005-304475 filed on Oct. 19, 2005 in the Japan Patent Office, the entire contents of which are incorporated by reference herein.

BACKGROUND

1. Field of Invention

Exemplary aspects of the present invention relate to a method and apparatus for image forming, and more particularly, to a method and apparatus for image forming capable of effectively correcting an output from a toner density sensor.

2. Description of the Related Art

A related art image forming apparatus has employed a two-component development method commonly known in the art. This two-component development method develops an image by carrying a two-component developer (hereafter referred to as a developer) including a non-magnetic toner and a magnetic carrier on a development sleeve as a developer carrier, forming the developer in a magnetic-brush-like shape on the development sleeve by an action of magnetic poles included in the development sleeve, and applying a development bias to the development sleeve at a location opposing to a photoconductor as a latent image carrier. This two-component development method is advantageous in color image forming and, consequently, has been widely employed. In the two-component development method, the developer is carried to a development region with a rotation of the development sleeve. According to this movement of the developer, a large amount of the magnetic carriers in the developer are gathered with attached toner particles along lines of magnetic force of the development poles so that the developer is formed in a magnetic-brush-like shape.

Unlike a one-component development method, the two-component development method is believed to be important to efficiently control a weight ratio (referred to as a toner density) between a toner and the carrier to enhance stability. For example, when the toner density is excessively high, a background soiling is generated on the image, and a detail resolving power is decreased. When the toner density is low, deterioration of a solid image density or adhesion of the carrier is generated. Thereby, the toner quantity supplied to the developer is controlled, and the toner density in the developer needs to be controlled within an appropriate range. The toner density is controlled by comparing an output value Vt of a permeability sensor, serving as a toner density detection mechanism, with a reference value Vref density, and arranging the toner supply quantity based on a result of the comparison.

The permeability sensor is generally used to detect the toner density as permeability. The sensor detects a permeability variation of the developer caused by a variation of the toner density of the developer, and compares the output of the sensor with the reference density so as to determine the current value of the toner density. Another method uses an optical sensor toner density. The result detected by the optical sensor detects a reflection density of an image area and a non-image area of a reference pattern, which is formed on an image carrier or an intermediate transfer belt, so as to determine the toner density.

Another publicly known method is to control the reference value Vref of the permeability sensor based on a detection result of a toner adhesion amount of the reference pattern, which is formed between each of image outputs (between sheets), even during image forming operation. However, when the reference pattern is formed between the sheets, the toner is excessively consumed. This excess consumption of the toner needs to be reduced. Thereby, there is a tendency not to control the Vref by forming the reference pattern between the sheets. When the reference pattern is formed on the intermediate transfer belt, a cleaning device needs to be disposed on a secondary transfer roller. Thereby, there is a tendency not to form the reference pattern between the sheets from a cost reduction point of view. In such a case, the toner density needs to be correctly controlled by the permeability sensor solely when the images are continuously formed or an image mode is changed, such as the process linear velocity.

One example has attempted to detect the toner density of the developer in a development device by using the permeability sensor as the toner density detection mechanism, comparing a result detected by the permeability sensor with a threshold value, controlling the toner density in the development device based on a result of the comparison, and changing the threshold value with respect to a detection value of the toner density detection mechanism in response to a variation of a photoconductor linear velocity.

SUMMARY

An image forming apparatus using a two-component developer having toner and carriers includes a sensor mechanism, an image forming mechanism, a toner supply controller, a memory, an estimation mechanism, and a correction mechanism. The sensor mechanism is configured to detect a toner density of the developer. The image forming mechanism is provided with at least two selectable process linear speeds and configured to produce a toner image at one of the selectable process linear speeds. The toner supply controller is configured to control an amount of toner to be supplied to the image forming mechanism based on a detection result of the toner density by the sensor mechanism. The memory is configured to store data of an external input voltage for adjusting a variation in an output voltage of the sensor mechanism. The estimation mechanism is configured to estimate, based on the data of the external input voltage stored in the memory, a difference between output voltages of the sensor mechanism before and after a speed selection of the at least two selectable process linear speeds is changed from one to another. The correction mechanism is configured to correct the output voltage of the sensor mechanism when the selection of the at least two selectable process linear speeds is changed from one to another based on the difference between the output voltages of the sensor mechanism before and after the speed selection, which is estimated by the estimation mechanism.

In another embodiment, an image forming method using at least two selectable process linear speeds and forming a toner image at one of the at least two selectable process linear speeds selected by using a two-component developer including toner and carriers is carried out by the following steps: (1) providing a sensor mechanism for sensing a toner density of the developer; (2) storing data of an external input voltage for adjusting a variation in an output voltage of the sensor mechanism; (3) estimating, based on the data of the external input voltage stored by the storing step, a difference between output voltages of the sensor mechanism before and after a speed selection of the at least two selectable process linear speeds is changed from one to another; and (4) correcting the output voltage of the sensor mechanism when the selection of the at least two selectable process linear speeds is changed from one to another based on the difference between the output voltages of the sensor mechanism before and after the speed selection estimated by the estimating step.

An image forming apparatus provided with at least two selectable process linear speeds and forming a toner image at one of the at least two selectable process linear speeds selected with using a two-component developer includes a sensor mechanism, a memory, a means for estimating, and a means for correcting. The sensor mechanism is used for sensing a toner density of the developer. The memory is used for storing data of an external input voltage for adjusting a variation in an output voltage of the sensor mechanism. The means for estimating may be performed based on the data of the external input voltage stored by the storing step, a difference between output voltages of the sensor mechanism before and after a speed selection of the at least two selectable process linear speeds is changed from one to another by applying a quadratic approximation formula with respect to the data of the external input voltage. The means for correcting the output voltage of the sensor mechanism may be performed when the selection of the at least two selectable process linear speeds is changed from one to another based on the difference between the output voltages of the sensor mechanism before and after the speed selection estimated by the means for estimating the difference.

BRIEF DESCRIPTION OF THE DRAWINGS

A more complete appreciation of the exemplary aspects of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
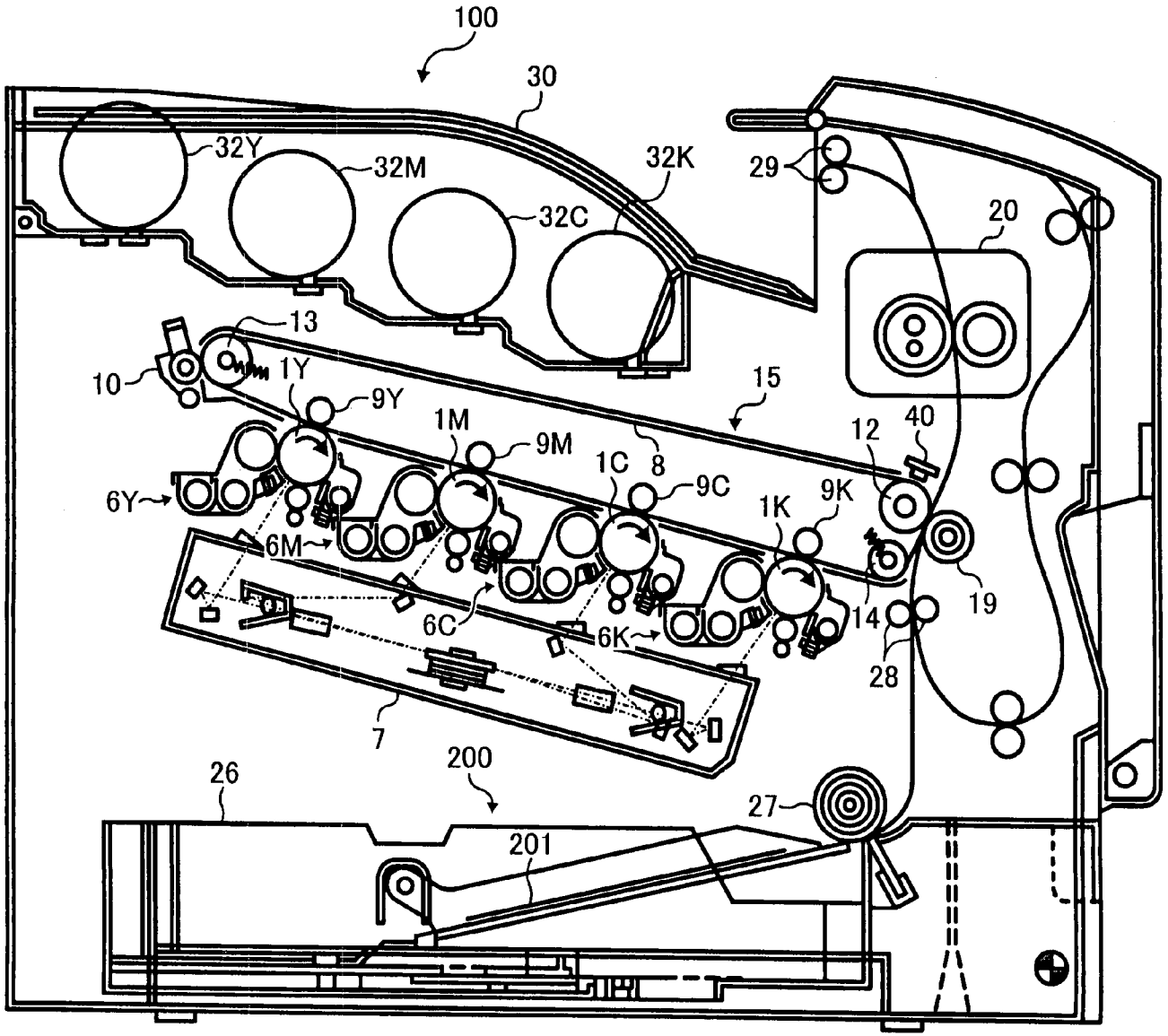
FIG. 1 is a cross sectional view illustrating an image forming apparatus according to an exemplary embodiment of the present invention.

In describing the exemplary embodiments illustrated in the drawings, specific terminology is employed for the sake of clarity. However, the disclosure of this patent specification is not intended to be limited to the specific terminology selected, and it is to be understood that each specific element includes all technical equivalents that operate in a similar manner. Referring now to the drawings, wherein like reference numerals designate identical or corresponding parts throughout the several views, an image forming apparatus according to at least first exemplary embodiment of the present invention is described.

Referring to FIG. 1, the image forming apparatus 100 forming a toner image on a transfer sheet with an electrophotographic method includes process cartridges (also referred to as toner image forming units) 6Y, 6M, 6C, and 6K, an optical writing unit 7, a sheet feeding mechanism 200, a pair of registration rollers 28, an intermediate transfer unit 15, a secondary transfer roller 19, a fixing device 20, a pair of ejection rollers 29, a stacking area 30, toner bottles 32Y, 32M, 32C, and 32K, and a reflective photo sensor 40. The process cartridges 6Y, 6M, 6C, and 6K respectively include photoconductors 1Y, 1M, 1C, and 1K as latent image carriers. The symbols Y, M, C, and K respectively indicate toner colors of yellow, magenta, cyan, and black, and these symbols may be omitted as necessary. The sheet feeding mechanism 200 includes a feeding roller 27 and a sheet cassette 26 in which a transfer sheet 201 is stored. The intermediate transfer unit 15 includes an intermediate transfer belt 8 as an intermediate transfer member, primary transfer bias rollers 9Y, 9M, 9C, and 9K, a cleaning device 10, a secondary transfer backup roller 12, a cleaning backup roller 13, and a tension roller 14.

The process cartridges 6Y, 6M, 6C, and 6K are removable and respectively form the toner images of yellow, magenta, cyan and black (referred to as Y toner image, M toner image, C toner image, and K toner image). A detailed description of one of the process cartridges will be given with FIG. 2.

The optical writing unit 7 as an exposure device applies laser lights on the photoconductors 1Y, 1M, 1C, 1K on which electrostatic latent images are formed. The sheet cassette 26 and the feeding roller 27 of the sheet feeding mechanism 200 respectively stores a plurality of the transfer sheets 201 therein, and feeds the transfer sheet 201 towards the registration rollers 28. The pair of registration rollers 28 register the transfer sheet 201 so as to feed the sheet 201 towards a secondary transfer nip area which will be described later at an appropriate timing.

The intermediate transfer unit 15 forms the toner image onto the intermediate transfer belt 8. A detailed description of the intermediate transfer unit 15 will be given later. The secondary transfer roller 19 transfers the toner images onto the transfer sheet 201. The fixing device 20 fixes the toner image on the transfer sheet 201. The pair of ejection rollers 29 eject the transfer sheet 201 with the fixed image to the stacking area 30. The stacking area 30 is a place to stack the transfer sheet 201 ejected from the pair of ejection rollers 20. The toner bottles 32Y, 32M, 32C, and 32K store toners of yellow, magenta, cyan, and black respectively. The reflective photo sensor 40, as an image density detection mechanism, detects a density of the intermediate transfer belt 8 so as to output a signal in correspondence to an optical reflectance of the transfer belt 8. For the reflective photo sensor 40, among a diffusion light detection type and a regular reflection light detection type, a reflective photo sensor capable of providing an adequate value from a difference between a reflected light quantity of a surface of the intermediate transfer belt 8 and a reflected light quantity of a reference pattern image (described later) is employed.

In an image forming operation, the optical writing unit 7 emits a plurality of laser lights based on each image information of the toner colors Y, M, C, and K, and irradiates the photoconductors 1Y, 1M, 1C, and 1K included in the respective process cartridges 6Y, 6M, 6C, and 6K so as to form the electrostatic latent images on the respective photoconductors 1Y, 1M, 1C, and 1K. The optical writing unit 7 irradiates the photoconductors 1Y, 1M, 1C, and 1K through a plurality of optical lenses or mirrors while scanning deflectively a plurality of laser light sources by a polygon mirror, which is rotationally driven by a motor.

The sheet cassette 26 included in the sheet feeding mechanism 200 stores the plurality of the transfer sheets 201 so that each transfer sheet 201 is stacked on top of the one below. The feeding roller 27 abuts on one of the transfer sheets 201 stacked on the very top. When the feeding roller 27 is rotated by a drive mechanism (not shown) in a counterclockwise direction, the transfer sheet 201 stacked on the very top in the sheet cassette 26 is fed by the feeding roller 27 and conveyed to the registration rollers 28. The registration rollers 28 are driven rotationally so as to nip the transfer sheet 201. However, the registration rollers 28 stop immediately after the transfer sheet 201 is nipped. Then, the registration rollers 28 start moving to feed the transfer sheet 201 towards the secondary transfer nip area at the appropriate timing.

The intermediate transfer unit 15 is disposed such that the intermediate transfer belt 8 in an endless belt shape is laid across the secondary transfer backup roller 12, cleaning backup roller 13, and tension roller 14 in a tensioned condition. The intermediate transfer belt 8 is moved in a counterclockwise direction by at least one of the secondary transfer backup roller 12, cleaning backup roller 13, and tension roller 14 rotationally driven by a rotation driving unit.

The intermediate transfer belt 8 is nipped in primary transfer nip areas formed between the primary transfer bias rollers 9Y, 9M, 9C, and 9K and the respective photoconductors 1Y, 1M, 1C, and 1K. The primary transfer bias rollers 9Y, 9M, 9C, and 9K apply toner biases applied from a high voltage power source (not shown) to a backside (an inside circumference surface) of the intermediate transfer belt 8. The toner biases applied from the power source have reverse polarity against the toner. For example, the toner biases with plus polarity are applied from the power source. The secondary transfer backup roller 12, cleaning backup roller 13, and tension roller 14 are electrically grounded while the primary transfer bias rollers 9Y, 9M, 9C, and 9K are not grounded. The toner images of the yellow, magenta, cyan, and black on the respective photoconductors 1Y, 1M, 1C, and 1K are primarily transferred onto the intermediate transfer belt 8 in a process in which the intermediate transfer belt 8 sequentially passes the respective primary transfer nip areas. Thereby, a full color image is formed onto the intermediate transfer belt 8 by superimposing the images of the four colors.

The secondary transfer backup roller 12 and the secondary transfer roller 19 form the secondary nip area therebetween. The secondary transfer roller 19 is applied with the transfer bias from the high voltage power source (not shown). In the secondary transfer nip area, the full color image formed by superimposing the toner images of four colors onto the intermediate transfer belt 8 is transferred on the transfer sheet 201 fed from the registration roller 28. After the intermediate transfer belt 8 passes the secondary nip area, the cleaning device 10 removes a remaining toner which is not transferred on the transfer sheet 201 from the transfer belt 8. In the secondary transfer nip area, the transfer sheet 201 is nipped between the intermediate transfer belt 8 and the secondary transfer roller 16 both surfaces of which move in a forward direction, and is conveyed to a direction opposing to the registration rollers 28. The transfer sheet 201 fed from the secondary transfer nip area is conveyed to the fixing device 20 in which the full color toner image on the transfer sheet 201 is fixed by heat and pressure. After the full color image is fixed, the transfer sheet 201 is ejected to the stacking area 30 by the ejection rollers 29.

As shown in FIG. 1, the optical writing unit 7 and the intermediate transfer unit 15 are disposed respectively below and above the process cartridges 6Y, 6M, 6C, and 6K. The sheet feeding mechanism 200 is disposed below the optical wiring unit 7. The reflective photo sensor 40 is disposed above the secondary transfer backup roller 12, and a detail description thereof will be given later.

Figure 2:
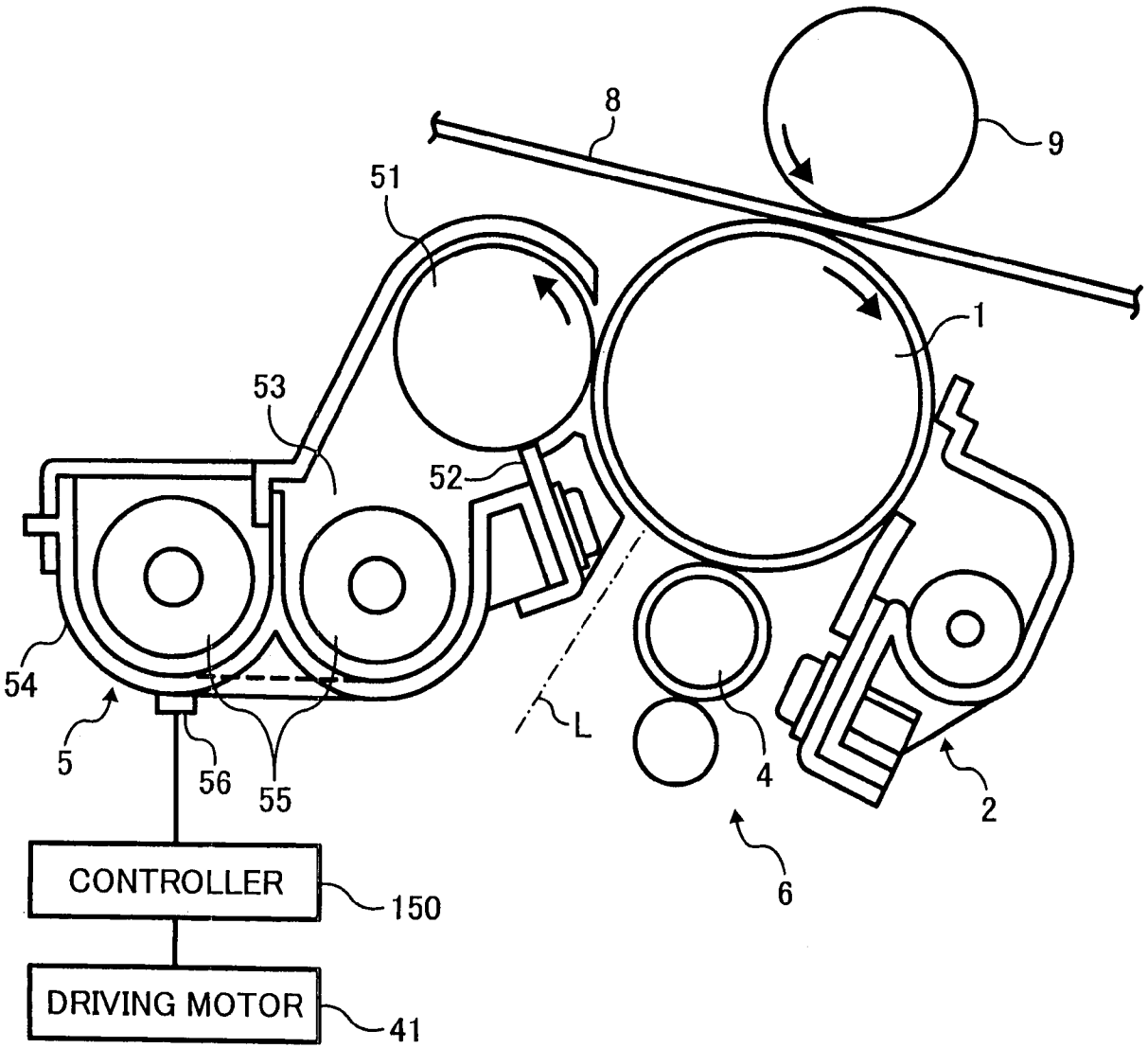
FIG. 2 is an enlarged cross sectional view illustrating a process cartridge included in the image forming apparatus of FIG. 1.

Referring to FIG. 2, since the process cartridges 6Y, 6M, 6C, and 6K included in FIG. 1 are configured to be the same except for the toner colors, one of the process cartridges 6Y, 6M, 6C, 6K is illustrated as an example process cartridge 6. The color symbols Y, M, C, and K indicating yellow, magenta, cyan, and black are omitted as necessary. The process cartridge may be replaced with a new one at the end of the lifetime thereof.

As shown in FIG. 2, the process cartridge 6 generating the toner image includes the photoconductor 1, a drum cleaner 2, a charging device 4, a development device 5 and a discharge device (not shown). The development device 5 includes a development sleeve 51, a control member 52, a two-component developer 53, a development container 54, and an agitation conveyance member 55.

The photoconductor 1 forms the electrostatic latent image thereon by the laser light applied by the optical writing unit 7 as described with FIG. 1. The laser light is indicated by a letter L in FIG. 2. The photoconductor 1 is rotated in a clockwise direction by a driving mechanism (not shown).

The charging device 4 uniformly charges a surface of the photoconductor 1. When the surface of the photoconductor 1 is uniformly charged, the laser light emitted from the optical writing unit 7 (see FIG. 1) based on the image information scans the surface of the photoconductor 1. Thereby, the electrostatic latent image is formed on the surface of the photoconductor 1. This electrostatic latent image on the photoconductor 1 is developed by the development device 5 including the two-component developer 53 so as to form the toner image. This two-component developer 53 includes a non-magnetic toner and a magnetic carrier. The primary transfer bias roller 9 is applied with the transfer bias from the high voltage power source (not shown), and a transfer electric field is formed between the primary transfer bias roller 9 and the photoconductor 1. The toner image on the photoconductor 1 is transferred on the intermediate transfer belt 8 by the transfer electric field.

The drum cleaner 2 removes a remaining toner from the surface of the photoconductor 1 on which an intermediate transfer process is undergone. The discharge device (not shown) discharges a residual charge of the photoconductor 1 after the drum cleaner 2 removes the remaining toner. The discharge process by the discharge device causes the surface of the photoconductor 1 to initialize for the next image forming operation.

The development device 5 develops the electrostatic latent image on the photoconductor 1 to form the toner image. In the development device 5, the agitation conveyance member 55 agitates and conveys the two-component developer 53 having the non-magnetic toner and the magnetic carrier, and the development sleeve 51 as a developer carrying member includes a magnetic pole therein which forms a magnetic brush. The development container 54 supports the agitation conveyance member 55. The agitation conveyance member 55 and the development sleeve 51 are rotationally driven by a rotation driving device (not shown). When a process linear velocity of the image forming apparatus is changed, rotation speeds of the agitation conveyance member 55 and the development sleeve 51 are changed by the rotation driving device (not shown). The development device 5 has a permeability sensor 56 (hereafter referred to as a P sensor 56) as a toner density sensor disposed below thereof. This P sensor 56 detects the toner density (also referred to as a permeability) in the development device 5, and is controlled by a control unit 150 which will be described in FIG. 3. As shown in FIG. 2, the control unit 150 is connected with a toner supply motor 41 which supplies a toner from the toner bottle 32 (shown as 32Y, 32M, 32C, and 32K in FIG. 1). The developer 53 on the development sleeve 51 is conveyed to a development area with a rotation of the development sleeve 51. As the developer 53 is conveyed to the development area, a plurality of the magnetic carriers in the developer 53 are gathered with the toner along with a magnetic line of force of a development pole so as to form the magnetic brush. The control member 52 controls a thickness of the developer 53 on the development sleeve 51. The development sleeve 51 is applied with the development bias from the high voltage power source at a location opposing to the photoconductor 1 so that the electrostatic latent image on the photoconductor 1 is developed by adhering the toner in the developer on the development sleeve 51.

Therefore, the process cartridges 6Y, 6M, 6C, and 6K (shown as 6 in FIG. 2) respectively include the photoconductors 1Y, 1M, 1C, and 1K shown in FIG. 1, the drum cleaners 2Y, 2M, 2C, and 2K (shown as 2 in FIG. 2), discharge devices (not shown), charging devices 4Y, 4M, 4C, and 4K (shown as 4 in FIG. 2), and development devices 5Y, 5M, 5C, and 5K (shown as 5 in FIG. 2). These process cartridges 6Y, 6M, 6C, and 6K respectively form the Y, M, C, and K toner images on the photoconductors 1Y, 1M, 1C, and 1K. The Y, M, C, and K toner images are superimposed and transferred on the intermediate transfer belt 8 by the respective primary transfer bias rollers 9Y, 9M, 9C, and 9K shown in FIG. 1 (also shown as 9 in FIG. 2) so as to form the full color image. The development device 5Y, 5M, 5C, and 5K respectively include development sleeves 51Y, 51M, 51C, and 51K (shown as 51 in FIG. 2), developers 53Y, 53M, 53C, and 53K (shown as 53 in FIG. 2), and toner supply motors 41M, 41M, 41C, and 41K (shown as 41 in FIG. 2).

Figure 3:
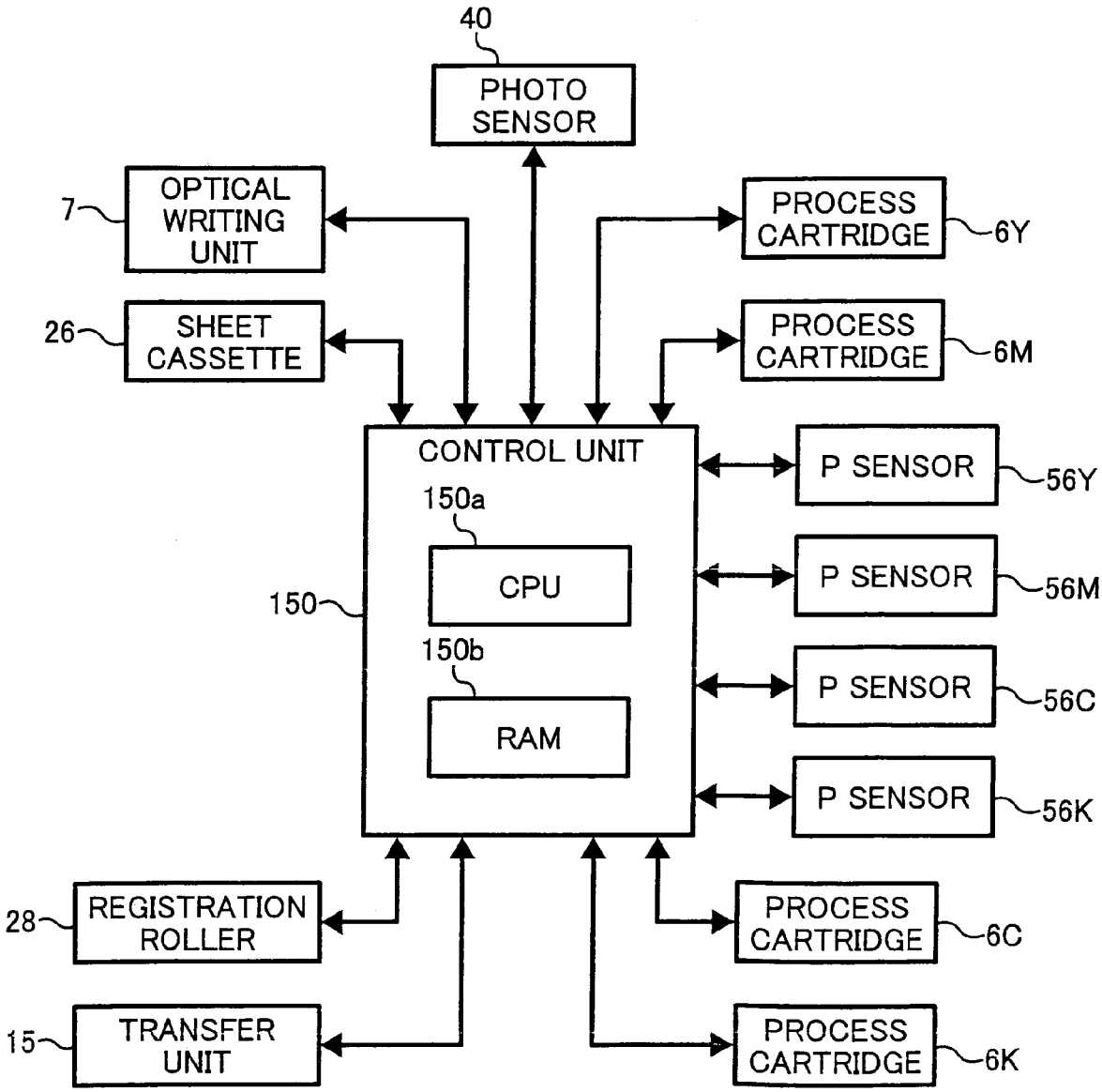
FIG. 3 is a block diagram illustrating a portion of an electric circuit for the image forming apparatus of FIG. 1.

Referring to FIG. 3, a portion of an electric circuit of the image forming apparatus includes the control unit 150. The control unit 150 includes a central processing unit (CPU) 150*a* to control, for example, a computation unit, and a random access memory (RAM) 150*b* to store data. This control unit 150 controls, for example, process cartridges 6Y, 6M, 6C, and 6K, the optical writing unit 7, the sheet cassette 26, the pair of registration rollers 28, the intermediate transfer unit 15, the reflective photo sensor 40, and the permeability sensors 56Y, 56M, 56C, and 56K, each of which is electrically connected.

The control unit 150 examines an image forming capability, for example, the image forming capability of each process cartridge 6Y, 6M, 6C, and 6K at a predetermined timing, for example, when a main power source (not shown) of the image forming apparatus is activated, during standby after a predetermined time period is passed from the activation of the main power source, or during standby after the images are formed on at least a predetermined number of sheets. Thereby, the control unit 150 controls the toner supply quantity to the development devices 5Y, 5M, 5C, and 5K from respective toner supply devices during sheet feeding.

Specifically, the control unit 150 reads the photo sensor 40 when the predetermined timing is provided. During the reading of the photo sensor 40, the control unit 150 sequentially changes a light emitting quantity of the photo sensor 40 while being in a non-image forming state so as to determine the light emitting quantity at which a detection voltage of the photo sensor becomes 4.0V±0.2V. The control unit 150 uses the light emitting quantity when the toner adhesion amount of the pattern image is detected. The control unit 150 controls a motor which rotates the photoconductors 1Y, 1M, 1C, and 1K, and causes the charging devices 4Y, 4M, 4C, and 4K to uniformly charge the photoconductors 1Y, 1M, 1C, and 1K while rotating the photoconductors. This charging operation differs from a uniform charging process, for example, −700V charging, during a normal image forming operation. In other words, the control unit 150 controls the high voltage power source which applies the voltage to the charging devices 4Y, 4M, 4C, and 4K such that charging potentials of photoconductors 1Y, 1M, 1C, and 1K are gradually increased. While the control unit 150 controls the optical writing unit 7 to form the electrostatic latent images for the reference pattern images on the photoconductors 1Y, 1M, 1C, and 1K by scanning with the laser light, the electrostatic latent images for the reference pattern images on the photoconductors 1Y, 1M, 1C, and 1K are developed by the development devices 5Y, 5M, 5C, and 5K. Thereby, the reference pattern images of yellow, magenta, cyan, and black are formed on the respective photoconductors 1Y, 1M, 1C, and 1K.

In a course of the development process, the control unit 150 controls the high voltage power source such that the development biases applied from the high voltage power source to the development sleeves 51Y, 51M, 51C, and 51K in the respective development devices 5Y, 5M, 5C, and 5K are gradually increased. In this manner, the reference pattern image is formed by forming a plurality of reference image patches from a low image density to a higher image density. In other wards, image densities of the plurality of reference image patches in the reference pattern image are gradually increased. A method for forming the reference pattern image will be described later.

On the other hand, when both the charging potentials and development biases of the photoconductors 1Y, 1M, 1C, and 1K are gradually decreased, the reference image patches in the reference pattern image are formed from a high image density to a lower image density. However, as the high voltage power source generally consumes a more time reducing a voltage than increasing the voltage, a time necessary to form the reference pattern images may be extended.

The reference pattern images on the respective photoconductors 1Y, 1M, 1C, and 1K are transferred to be sided one another onto the transfer belt 8, not to be superimposed one on another. When each reference pattern image passes the location opposing to the photo sensor 40 with a movement of the intermediate transfer belt 8, each thereof reflects the light emitted from the reflective photo sensor 40, and a reflected light quantity reflected by each reference pattern image is detected by the reflective photo sensor 40 so as to be output to the control unit 150 as an electric signal. The control unit 150 computes an optical reflectance of each of the plurality of reference image patches based on an output value of the reflective photo sensor 40 sequentially transmitted from the reflective photo sensor 40 in corresponding to detection of the reflected light quantity of each reference image patch in the reference pattern image on the intermediate transfer belt 8. The control unit 150 stores data of the optical reflectance computed for each reference image patch in the RAM 150*a* as density pattern data. When the reference pattern images on the intermediate transfer belt 8 pass through the location opposing to the reflective photo conductor 40, the reference pattern images are removed by the cleaning device 10.

Figure 4:
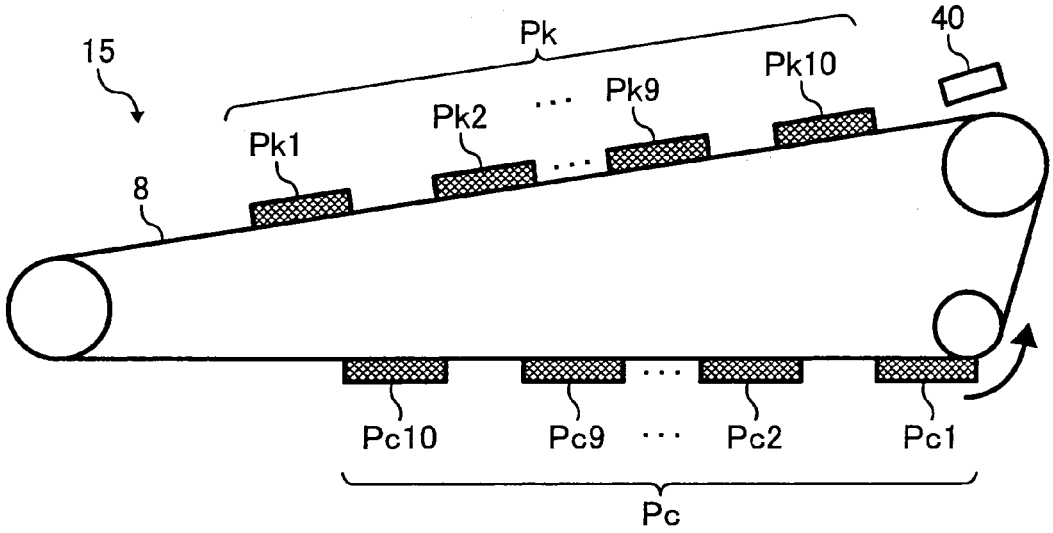
FIG. 4 is a schematic diagram illustrating reference patterns of two colors on an intermediate transfer belt included in the image forming apparatus of FIG. 1.

Referring to FIG. 4, the reference pattern images on the intermediate transfer belt 8 are illustrated. As shown in FIG. 4, the reference pattern images of black and cyan are respectively indicated as Pk and Pc as examples. The reference pattern image of yellow (Py) or magenta (Pm) is not shown in FIG. 4, however, configuration thereof is the same as that of black or cyan. Each reference pattern image includes 10 reference image patches. For example, the reference pattern image Pk includes 10 reference image patches Pk1 through Pk10, and the reference pattern image Pc includes 10 reference image patches Pc1 through Pc10. These 10 reference image patches are formed and sided 13 mm away from one another on the intermediate transfer belt 8, and each reference image patch is sized at 13 mm×15 mm according to the image forming apparatus. Thereby, each reference pattern image Pk, Pc, Py, and Pm having the respective 10 reference image patches has a length L2 that is 247 mm. Unlike the full color toner image formed by superimposing the toner image of one color on another, the reference pattern images Pk, Pc, Py, and Pm are formed at appropriate timings so as to be sided and transferred on the intermediate transfer belt 8 without superimposition.

As shown in FIG. 4, the reflective photo sensor 40 is disposed above in the intermediate transfer unit 15 which includes the intermediate transfer belt 8. After the reflective photo sensor 40 detects each reference pattern image on the intermediate transfer belt 8 with the movement of the intermediate transfer belt 8, the cleaning device 10 removes each reference pattern image from the intermediate transfer belt 8. The reflective photo sensor 40 detects the reflected light quantity from each of the plurality of reference image patches included in the reference pattern images Pk, Pc, Pm, (not shown) and Py (not shown). In other words, the reflective photo sensor 40 sequentially detects densities for the 10 reference image patches Pk1 through Pk10 included in the reference pattern image Pk, the 10 reference image patches Pc1 through Pc10 included in the reference pattern image Pc, the 10 reference image patches Pm1 through Pm10 included in the reference pattern image Pm, and the 10 reference image patches Py1 through Py10 included in the reference pattern image Py. In this case, the reflective photo sensor 40 detects the reflected light quantity of each reference image patch, and sequentially outputs the signal to the control unit 150 (shown in FIG. 3) based on the reflected light quantity. The control unit 150 sequentially computes the image density of each reference image patch, and stores in the RAM 150*b* (shown in FIG. 3) based on the signals sequentially transmitted from the reflective photo conductor 40.

The image density of each reference image patch is converted into the toner adhesion amount by a conversion method. According to the conversion method, the control unit 150 converts detection outputs of the reference pattern image Pk, Pc, Pm, and Py having respective 10 reference image patches from the reflective photo sensor 40 into toner adhesion amount data of the reference image patches based on a relationship between a detection voltage of the reflective photo sensor 40 respect to the reference image patches and the toner adhesion amount of the reference image patches (the toner density of the developer) shown in FIG. 5. The control unit 150 stores the toner adhesion amount data converted from the image density in the RAM 150*b*. A detailed description of FIG. 5 will be given later. The control unit 150 stores the toner adhesion amount data in the RAM 150*b* while estimating the development potentials of the reference pattern images based on an image forming condition of each reference pattern image so as to store information on the reference pattern image in the RAM 150*b*.

The control unit 150 performs above operations, for example, conversion of the image density into the toner adhesion amount, on the reference image patches Pk1, Pc1, Pm1, and Py1 in sequence. The development potential of each reference pattern image and the toner adhesion amount obtained by the control unit 150 is shown in FIG. 6.

Figure 6:
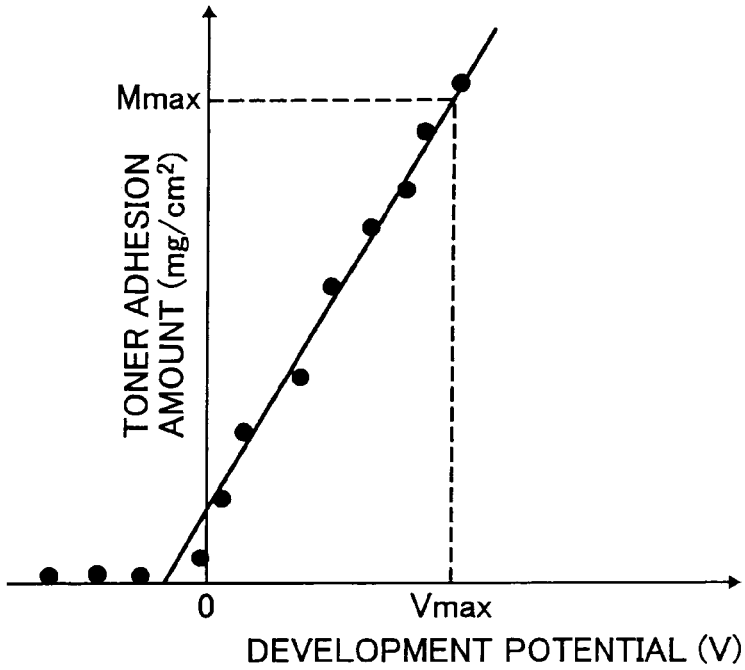
FIG. 6 is a graph showing a relationship between a development potential and a toner adhesion amount of the reference pattern in the exemplary embodiment.

Referring to FIG. 6, a relationship between the development potential of each reference pattern image and the toner adhesion amount is plotted. An X-axis shows the development potential that is a difference between a development bias $V_B$ and a reference pattern image potential $V_D$, $V_B$-$V_D$ (V). A Y-axis shows the toner adhesion amount per unit area (mg/cm$^2$). The control unit 150 selects a linear region of the relationship between the development potential of the reference pattern image and the toner adhesion amount based on plotted data in FIG. 6, and applies a least squares method with respect to data within the linear region. Thereby, the control unit 150 calculates a straight line equation A obtained by a linear approximation of the relationship between the development potential of the reference pattern image and the toner adhesion amount for each color. By using the straight line equation A, the control unit 150 calculates the development potential for obtaining a target toner adhesion amount, and attempts to maintain the image density by feeding back to the image condition of the reference pattern image.

Figure 8:
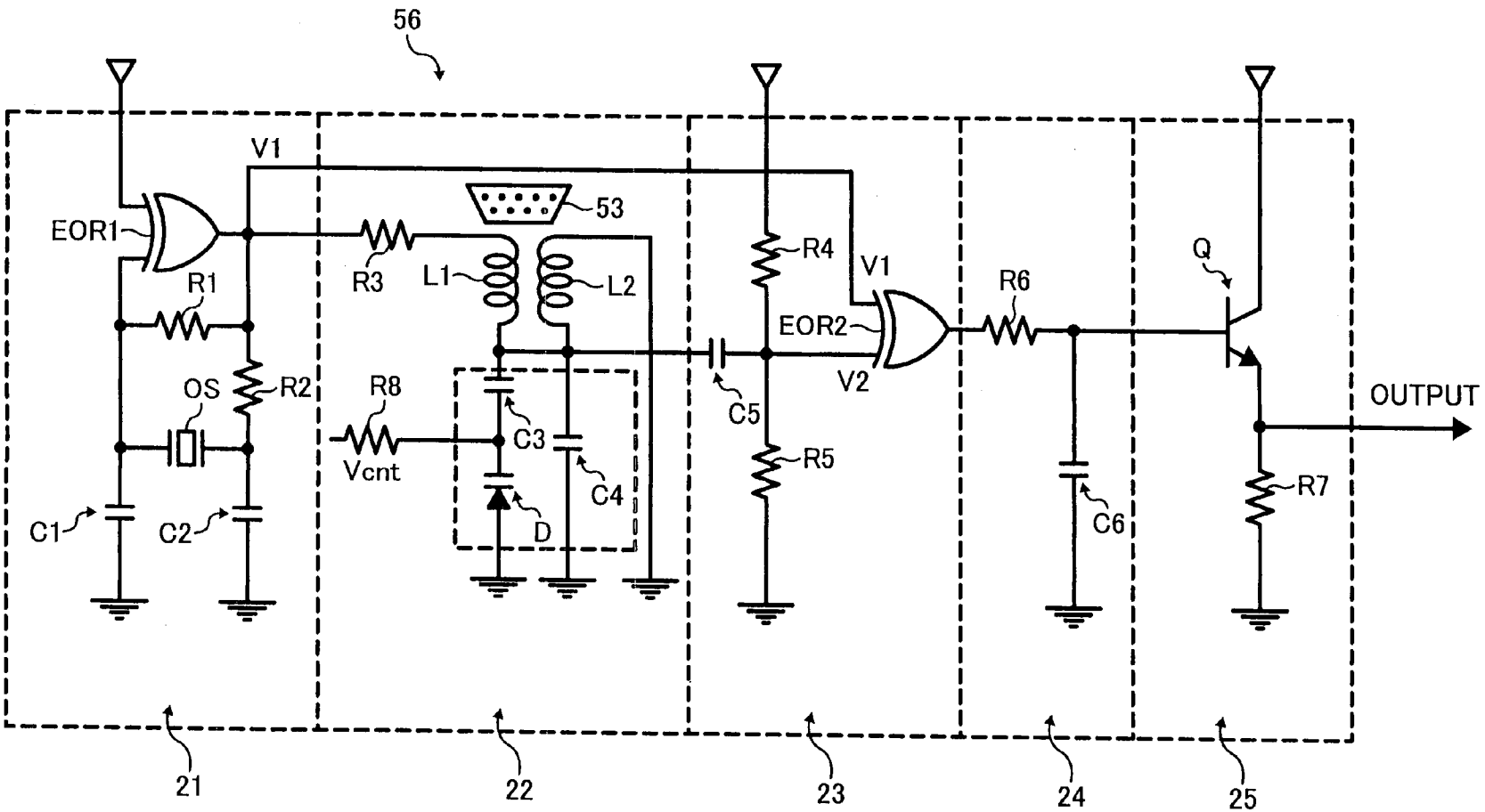
FIG. 8 is a schematic circuit diagram illustrating a configuration of the permeability sensor used in the exemplary embodiment.

Referring to FIG. 8, since the P sensors 56Y, 56M, 56C, and 56K are configured to be the same except for the toner colors, one of the P sensors 56Y, 56M, 56C, and 56K is illustrated as an example P sensor 56. The color symbols Y, M, C, and K indicating yellow, magenta, cyan, and black are omitted as necessary. As shown in FIG. 8, the P sensor 56 includes an oscillator 21, a resonance circuit 22, a phase comparison circuit 23, an integrating circuit 24 and an impedance exchange circuit 25.

The oscillator 21 includes a resonator OS of a solid matter, for example, a crystal and a ceramic, a capacitor C1, a capacitor C2, an exclusive OR circuit EOR1, and resistances R1 and R2. The oscillator 21 oscillates at an oscillation frequency which is determined by a property of a vibration frequency of the solid resonator OS.

The resonance circuit 22 includes a first LC resonance circuit, a second LC resonance circuit, a resistance R3, and a resistance R8. The first LC resonance circuit includes a coil L1, a capacitor C3, and a variable-capacitance diode D. The second LC resonance circuit includes a coil L2, and a capacitor C4. The coils L1 and L2 are coupled by a magnetic coupling constant k.

The oscillation frequency of the oscillator 21 is close to resonance frequencies of the first and second LC resonance circuits in the resonance circuit 22, and the coils L1 and L2 have inductances which may be varied by the permeability of the developer 53 in the development device 5. In the variable-capacitance diode D, a control voltage as an external input voltage Vcnt from the control unit 150 is applied across both terminals through the resistance R8, and a capacitance is varied depending on the external input voltage Vcnt. The resonance circuit 22 receives an output from the oscillator 21, and an output from the resonance circuit 22 is varied by a difference between the oscillation frequency of the oscillator 21 and the resonance frequency of the resonance circuit 22.

The resonance frequency of the resonance circuit 22 is varied by the permeability of the developer 53 in the development device 5, and the permeability of the developer 53 is detected by varying the output of the resonance circuit 22.

The phase comparison circuit 23 includes an exclusive OR circuit EOR2, a capacitor C5, a resistance R4, and a resistance R5. The phase comparison circuit 23 detects a phase difference by comparing an output phase of the oscillator 21 and an output phase of the resonance circuit 22. As shown in FIG. 8, the exclusive OR circuit EOR1 outputs an output V1 which is input to one of input areas of the exclusive OR circuit EOR2. The capacitor C5, the resistance R4, and the resistance R5 are connected so as to input an output V2 to another input area of the exclusive OR circuit EOR2.

The integrating circuit 24 includes a resistance R6, and a capacitor C6. The integrating circuit 24 integrates an output value of the phase comparison circuit 23. The impedance exchange circuit 25 includes a transistor Q and a resistance R7. The impedance exchange circuit 25 performs an impedance exchange. An output value from the integrating circuit 24 as a toner density detection signal in corresponding to a variation of the permeability of the developer 53 in the development device 5 is output to the control unit 150 through the impedance exchange circuit 25.

In the image forming apparatus of the present invention, when a new process cartridge, for example 6Y, is installed, the P sensor, for example 56Y, is read. Each of the development devices 5Y, 5M, 5C, and 5K in the respective new process cartridges 6Y, 6M, 6C, and 6K is filled with a developer having the toner density of 8 wt %. The control unit 150 reads the P sensor 56 by sequentially varying the external input voltage Vcnt of the P sensor 56 such that an output value Vt of the P sensor 56 becomes 2.5V with respect to the developer with the toner density of 8 wt %. The control unit 150 stores the external input voltage Vcnt of the P sensor 56 obtained during reading for a color basis. When the permeability of the developer 53 in the development device 5 is detected by the P sensor 56, the Vcnt for respective color stored in the RAM 150*b* is set to the P sensor 56, for example, by applying to the variable-capacitance diodes D of the P sensor 56.

When the transfer sheet is fed in a normal printing operation, the permeability of the developer 53 in the development device 5 during the sheet feeding is detected by the P sensor 56. The control unit 150 compares a target value Vref of the P sensor 56 and the output value Vt of the P sensor 56 so as to control the toner supply quantity to the development device 5 from the toner supply device based on a difference of the comparison. Specifically, the control unit 150 determines the toner supply quantity of each toner supply device depending on whether or not to satisfy an expression (Vt−Vref)>Vref by using Formulas 1 and 2 stated later. During a next image forming in the printing operation, the control unit 150 drives the toner supply motors 41 (shown in FIG. 2) to be rotationally driven so that the toner supply device supply the toner with the determined toner supply quantity to the development devices 5 by the toner supply motors 41 (see FIG. 2).

$$Ts=\alpha\times(Vt-Vref)/Sp, \qquad \text{Formula 1:}$$

where Ts represents the toner supply quantity, α represents a proportionality coefficient, and Sp represents the P sensor sensitivity. Formula 1 is satisfied when the output value Vt is greater than the target value Vref.

$$Ts=0, \qquad \text{Formula 2:}$$

where Ts represents the toner supply quantity. Formula 2 is satisfied when the output value Vt is equal to or smaller than the target value Vref.

Here, the control unit 150 measures the output value Vt of the P sensor 56 with respect to the permeability of the developer 53 in the development device 5, and updates the value Vref stored in the control 150 based on the measured output value Vt. In Formula 1, α is the proportionality coefficient which determines a response of the toner supply quantity with respect to the output value of the P sensor 56. In this exemplary embodiment, α=0.3.

Figure 5:
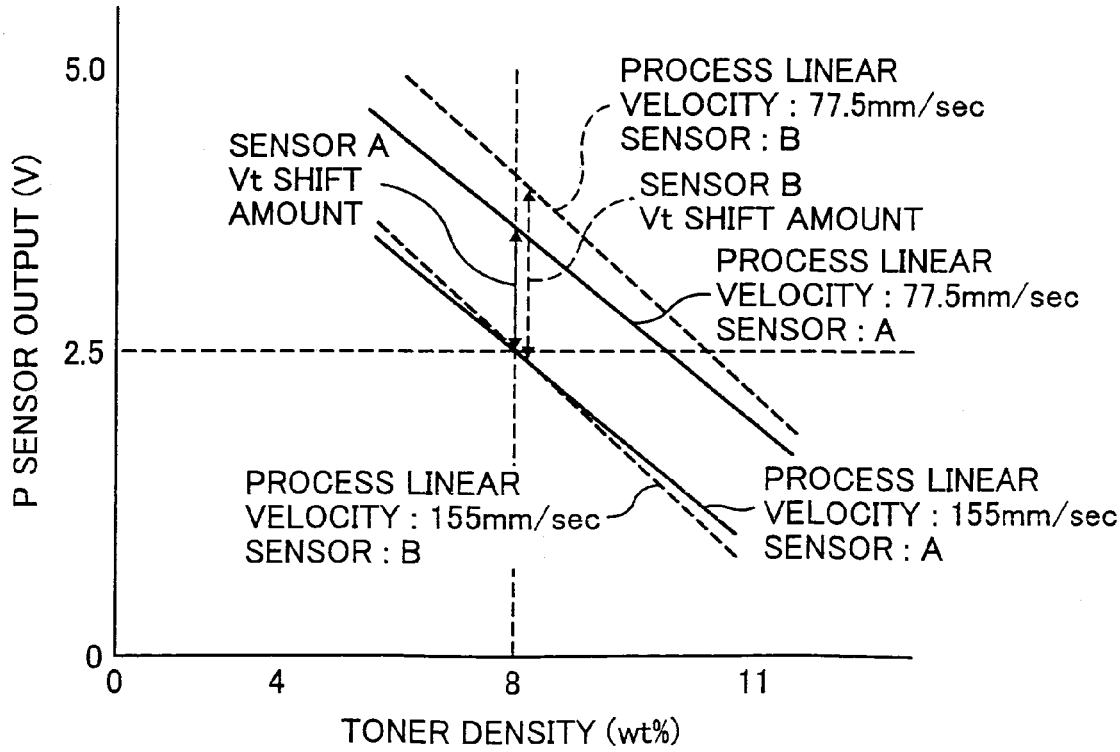
FIG. 5 is a graph showing a relationship between a detection voltage with respect to a reference image patch of a photo sensor and a toner adhesion amount of the reference image patch in the exemplary embodiment.

Referring to FIG. 5, a relationship between the output value of the P sensor 56 and the toner density in a process linear velocity is illustrated. As shown in FIG. 5, when a normal process linear velocity of 155 mm/sec and a half of the normal process linear velocity of 77.5 mm/sec are compared, there is a tendency that a slower process linear velocity has a higher Vt value with respect to the same toner density. Hereafter, a difference of the output value Vt of the P sensor 56 with respect to a difference of the process linear velocity is referred to as a Vt shift amount. When the output value Vt of the P sensor 56 with respect to the permeability of the developer 53 in the development device 5 at half of the normal process velocity is substituted into the formula 1, the toner supply quantity becomes excessive because of the Vt shift amount. Consequently, when the transfer sheet is fed at half of the normal process linear velocity, a Formula 3 stated below is expressed in which a HalfVt is the output value of the P sensor at half of the normal process linear velocity, Vt is the output value of the P sensor 56 at the normal process, and VtS is the Vt shift amount.

$$Vt=\text{Half}Vt-VtS \qquad \text{Formula 3:}$$

The control unit 150 converts the half velocity HalfVt of the P sensor into the Vt at the normal process velocity by Formula 3, and estimates an output variation of the P sensor 56 by the external input voltage Vcnt so as to determine the toner supply quantity according to Formulas 1 and 2. However, the Vt shift amount may vary depending on the P sensor 56, for example, P sensors A and B as shown in FIG. 5. This variation of the Vt shift amount may cause the toner supply quantity during the sheet feeding at the half of the normal velocity to deviate from a target toner supply quantity, and the toner density may not be stabilized. Thereby, the control unit 150 calculates the Vt shift amount by the Vcnt value at which the P sensor 56 is read so as to correct the variation of the Vt shift amount.

Figure 7:
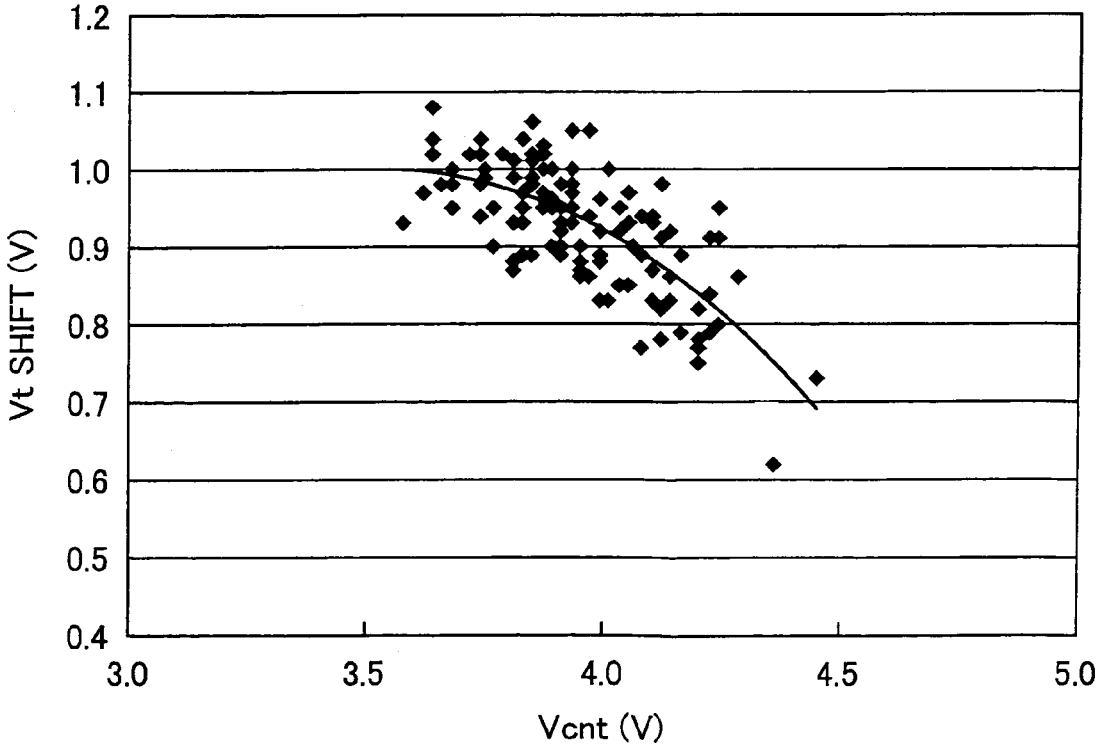
FIG. 7 is a graph showing a relationship between an external input voltage value at which a permeability sensor is read and a shift amount of an output from the permeability sensor at which a process linear velocity is switched.

Referring to FIG. 7, a relationship between the Vcnt value at which the P sensor is read and the Vt shift amount at which the process linear velocity is switched is graphed. As shown in FIG. 7, the Vct value and Vt shift amount have a correlation, and are approximated at a quadratic curve. The Vt shift amount is a difference between a Vt value before the process linear velocity is switched and a Vt value after the process linear velocity is switched. The control unit 150 calculates the Vt shift amount with respect to the Vcnt value by utilizing the correlation to store in the memory in the image forming apparatus so that the Vt shift amount is used for calculating the Vt of Formula 3. Specifically, the control unit 150 calculates the Vt shift amount by a Formula 4 stated below to store in the memory in the image forming apparatus so that the Vt shift amount is used for calculating the Vt of Formula 3.

$$VtS=-0.3728\times(Vcnt)^2+2.6397\times(Vcnt)-3.6733, \qquad \text{Formula 4:}$$

where VtS represents the Vt shift amount, and Vcnt represents the external input voltage.

The variation of the Vt shift amount with a maximal range of 0.5V may be decreased to ±0.1V by calculating Formula 4 as shown in FIG. 7. Thereby, the toner supply quantity at which the process linear velocity is switched may be controlled with a higher accuracy.

According to the exemplary embodiment of the present invention, the external input voltage Vcnt by which the output variation from the resonance circuit 22 of the P sensor 56 is adjusted is stored, and the Vt shift amount of the P sensor 56 at which the process linear velocity is switched in the same toner density is estimated based on the stored external input voltage. Thereby, the output value Vt of the P sensor at which the process linear velocity is switched is corrected by the Vt shift amount so that the toner supply quantity at which the process linear velocity is switched may be accurately controlled.

According to the exemplary embodiment of the present invention, the output variation from the resonance circuit 22 of the P sensor 56 is adjusted by the external input voltage Vcnt with the developer having a given toner density so that the P sensor is read by a certain condition. Thereby, the output variation of the P sensor may be estimated by the external input voltage Vcnt so that the Vt shift amount of the P sensor at which the process linear velocity is switched is accurately predicted.

According to the exemplary embodiment of the present invention, the Vt shift amount of the P sensor at which the process linear velocity is switched is calculated by a quadratic approximation formula with employing the external input voltage Vcnt by which the output variation from the resonance circuit 22 of the P sensor is adjusted. Thereby, the Vt shift amount of the P sensor at which the process linear velocity is switched may be accurately estimated.

Numerous additional modifications and variations are possible in light of the above teachings. It is therefore to be understood that within the scope of the appended claims, the disclosure of this patent specification may be practiced otherwise than as specifically described herein.

What is claimed is:

1. An image forming apparatus configured to use a two-component developer including toner and carriers, the apparatus comprising:

a sensor mechanism configured to detect a toner density of the developer;

an image forming mechanism provided with at least two selectable process linear speeds and configured to produce a toner image at one of the selectable process linear speeds;

a toner supply controller configured to control an amount of toner to be supplied to the image forming mechanism based on the toner density detected by the sensor mechanism;

a memory configured to store data of an external input voltage for adjusting a variation in an output voltage of the sensor mechanism;

an estimation mechanism configured to estimate, based on the data of the external input voltage stored in the memory, a difference between respective output voltages of the sensor mechanism before and after a selection of the at least two selectable process linear speeds is changed; and a correction mechanism configured to correct the output voltage of the sensor mechanism when the selection of the at least two selectable process linear speeds is changed, based on the estimated difference between the respective output voltages of the sensor mechanism before and after the selection, as estimated by the estimation mechanism.

2. The apparatus of claim 1, wherein the estimation mechanism is configured to estimate, based on the variation stored in the memory, the difference between the respective output voltages of the sensor mechanism before and after the selection of the at least two selectable process linear speeds is changed so that the toner density of the developer remains substantially constant before and after the speed selection is changed.

3. The apparatus of claim 1, wherein the sensor mechanism includes a resonance circuit having a resonance frequency and including an inductor;

an oscillator having an oscillating frequency close to the resonance frequency of the resonance circuit; and an input circuit configured to input the external input voltage to the resonance circuit, wherein the sensor mechanism is configured to detect the toner density by detecting variations in a permeability of the developer based on a change in an inductance of the inductor and to adjust a variation in an output of the resonance circuit with the external input voltage input by the input circuit.

4. The apparatus of claim 3, wherein the sensor mechanism is configured to adjust the variation in the output of the resonance circuit with the external input voltage input by the input circuit by using a predetermined toner density of the developer.

5. The apparatus of claim 3, wherein the estimation mechanism is configured to estimate the difference between the respective output voltages of the sensor mechanism before and after a selection of the at least two selectable process linear speeds is changed by applying a quadratic approximation formula to the data of the external input voltage stored in the memory.

6. An image forming method that uses at least two selectable process linear speeds and forms a toner image at one of the selectable process linear speeds, using a two-component developer including toner and carriers, the method comprising:

sensing, by a sensor mechanism, a toner density of the developer;

storing data of an external input voltage for adjusting a variation in an output voltage of the sensor mechanism;

estimating, based on the data of the external input voltage stored by the storing step, a difference between respective output voltages of the sensor mechanism before and after a selection of the at least two selectable process linear speeds is changed; and correcting the output voltage of the sensor mechanism when the selection of the at least two selectable process linear speeds is changed based on the estimated difference between the respective output voltages of the sensor mechanism before and after the speed selection, as estimated in the estimating step.

7. The method of claim 6, wherein the estimating step comprises estimating, based on the stored variation, the difference between respective output voltages of the sensor mechanism before and after the selection of the at least two selectable process linear speeds is changed so that the toner density of the developer remains substantially constant before and after the speed selection is changed.

8. The method of claim 6, wherein the sensing step comprises:

detecting the toner density by detecting variations in a permeability of the developer based on a change in an inductance of an inductor, and adjusting a variation in an output of a resonance circuit with the external input voltage input by an input circuit.

9. The method of claim 8, further comprising adjusting the variation in the output of the resonance circuit with the external input voltage input by the input circuit by using a predetermined toner density of the developer.

10. The method of claim 8, wherein the estimating step comprises estimating the difference between the respective output voltages of the sensor mechanism before and after a selection of the at least two selectable process linear speeds is changed by applying a quadratic approximation formula to the data of the external input voltage stored by the storing step.

11. An image forming apparatus which is provided with at least two selectable process linear speeds and forms a toner image at one of the selectable process linear speeds, configured to use a two-component developer including toner and carriers, the apparatus comprising:

a sensor mechanism for sensing a toner density of the developer;

a memory configured for storing data of an external input voltage for adjusting a variation in an output voltage of the sensor mechanism;

means for estimating, based on the data of the external input voltage stored by the storing step, a difference between respective output voltages of the sensor mechanism before and after a speed selection of the at least two selectable process linear speeds is changed by applying a quadratic approximation formula to the data of the external input voltage; and means for correcting the output voltage of the sensor mechanism when the selection of the at least two selectable process linear speeds is changed, based on the estimated difference between the respective output voltages of the sensor mechanism before and after the selection, as estimated by the means for estimating the difference.

* * * * *